US006015353A

United States Patent [19]

Romano

[11] Patent Number: 6,015,353

[45] Date of Patent: Jan. 18, 2000

[54] GOLF SWING STROKE-ERROR-SIGNALLING SENSOR

[76] Inventor: Edward A Romano, 3563 Trevis Way, Carmel, Calif. 93923

[21] Appl. No.: 09/145,804

[22] Filed: Sep. 2, 1998

[51] Int. Cl.[7] ..... A63B 69/36

[52] U.S. Cl. ..... 473/236

[58] Field of Search ..... 473/236, 237

[56] References Cited

U.S. PATENT DOCUMENTS

| | | | |
|---|---|---|---|
| 2,660,436 | 11/1953 | Grossman | 473/237 |
| 3,325,168 | 6/1967 | Fyanes | 473/236 X |
| 3,730,529 | 5/1973 | Donofrio | 473/236 |
| 5,820,477 | 10/1998 | Redkey | 473/236 |

*Primary Examiner*—George J. Marlo

[57] ABSTRACT

A ball-impact-error sensor/amplifier is bonded to the ball hitting point of a golf club face and includes an adhesive backed base in the form of a soft plastic disc, ½ inch diameter×3/16 inch thick, with a center hole that holds a flat-ended, rigid probe ⅛ inch diameter×¼ inch long, seated upright on the club face so that for the forward swinging club to strike the ball solidly, the club face, probe and ball must compress together squarely at impact, failing which, the probe and wall of the probe base will spring-hinge aside under impact, thereby strongly amplifying impact errors into jarring and blatant mis-hits that must be curbed for ball striking mastery.

1 Claim, 1 Drawing Sheet

GOLF SWING STROKE-ERROR-SIGNALLING SENSOR

BACKGROUND

Skilled putters aim properly, center their stroke on the ball and hit through to the hole. Thereby the contact point of the putter face meets the ball in an arc that imparts sufficient roll inertia to the ball for it to track to the hole and drop in.

Prior art has not helped many golfers putt with the well groomed stroke of today's tour champions. Romano U.S. Pat. No. 5,474,299 describes a swing training machine that correctly models pendulum putting. However, inertia precludes any golfer from putting perfectly, tethered to a machine.

The fact is that a golfer must rely on muscle tone to steady and aim his frame correctly. Likewise, to swing the chosen ball-contact point of the putter unwaveringly back from and through the ball so the ball will roll without side-spin on track at proper speed.

Devices that do not help the golfer understand how to balance the club so its face will center and square up to the ball and target at impact without shearing the ball, do not help his putting strength.

The "Peltz" putter face clip-on training aid attempts to meet this challenge. Its fiddlesome to clip the unit to the club head then center its rails around the sweet spot. In position, the rails do not help the user learn to both square and center the clubface to the ball-target line. Moreover the rails barr putting with either the toe or heel areas of the club face. Respected pros including Chi Chi Rodriguez say its pays to putt with the toe or heel of the putter face to take break out of ondulating greens!

Golfers need a putter-face training aid whose Good/Bad ball-striking-error feedback enables a host of golfers to sink putts whether his eyes are open or shut!

SUMMARY OF THE INVENTION

The invention is a golfer's "Putting-Stroke-Error signalling Sensor applicable to full golf swings, tennis, baseball etc. A golfer uses the Sensor's tiny surface to drive the ball for training purposes, after bonding the sole of the unit to the hitting point of the club.

If stroke delivery is wayward, the ball spins aside with a severity that grabs the golfer's attention and incites him to try swinging more smoothly until he succeeds;, overcoming the Sensor's inherent ball scattering handicap influence.

When he swings a normal club, the swing smoothness acquired with sensor feedback, results in wonderful golf enjoyment.

FIG. 1 illustrates the invention.

DESCRIPTION OF PREFERRED EMBODIMENTS

Figure 1:
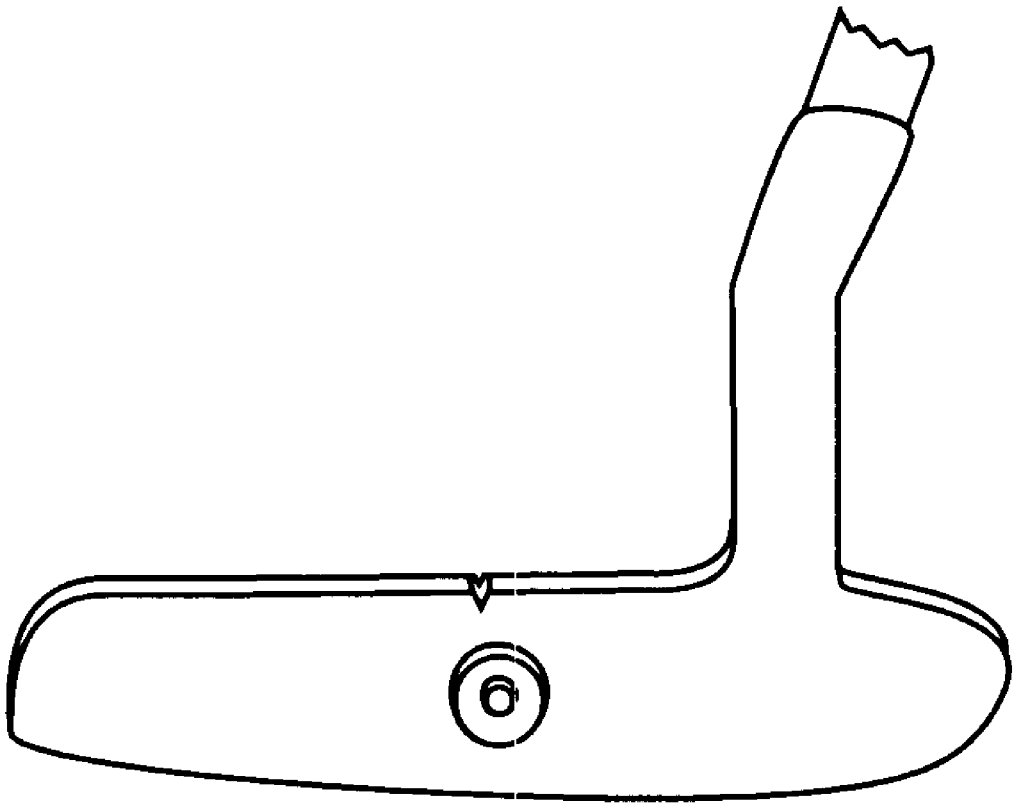

The present invention is a golfer's putting-stroke-error signalling sensor whose top surface the golfer uses as ball contact point, after seating the unit's sole on the corresponding part of the face of his club.

The sensor's ball-striking surface is the tip of a ⅛ inch diameter, rigid pin ¼ inch tall. Its flat sole bears directly on the club face, within a soft plastic skirt ½ inch diameter ×3⁄16 inch high.

After exposing the sticky back tape that lines the unit's sole, the golfer sets the unit on the normal ball-contact point of the putter face for the stroke he intends to practice.

The ball rolls sweetly at the target when he strokes correctly with the customary "click" at impact that greets a good putt.

If instead, the golfer feels the club jarr and "clunk" at impact he sees the ball spin away from the target, yet in proportion to the "Bad" glancing stroke it received. Thus the golfer sees, feels and hears when the putt is "Bad".

To benefit from the sensor's feedback the golfer does not have to know "You've got to square and center the sweet spot to the ball and target at impact, with the right speed and without shearing the ball etc etc!"

That good information doesn't help him do it whereas the sensor's intervention does because it incites him to try until he sinks putts consistently, regardless of the fact that ball scatter with the sensor is artificially high.

Interestly, on Aug. 18 '98 nearly a year after the original invention date, the inventor made unexpected discoveries: If the 5⁄16 inch diameter flat head of a ⅛ inch shank diameter metal rivet is situated in the Sensor skirt in place of the ⅛ dia pin, the sensor becomes incredibly sensitive to mis-hits and not the contrary. However if the skirt is hard, sensor sensitivity to mis-hits is reduced enough not to overwhelm a beginner!

Experiments with a sand wedge, show that a Sensor created by a raised/or depressed platform about 1 sq. inch in area and centered in the club face sweet spot, catalyses big improvement of the golf swing. Balls scatter from it teaches one to swing much better with a regular club.

CONCLUSION

The sensor described above will help anyone striking a ball for sport to improve dramatically!

I claim:

1. A ball-impact-error sensor/amplifier bonded to the ball hitting point of a golf club head for ball striker training, comprising, the head of a golf club, upon the intended ball striking point of which is bonded, the sensor's adhesive backed base in the form of a soft plastic disc ½ inch diameter×3⁄16 inch thick with a center hole that holds a flat-ended, rigid probe ⅛ inch diameter×¼ inch long, seated upright on the club face so that for the forward swinging club to strike the ball solidly, the club face, probe and ball must compress together squarely at impact, failing which, the probe and wall of the probe base will spring-hinge aside under impact, thereby strongly amplifying impact errors into jarring and blatant mis-hits that must be curbed for ball striking mastery.

* * * * *